US007421227B2

(12) United States Patent
Hamakawa et al.

(10) Patent No.: US 7,421,227 B2
(45) Date of Patent: Sep. 2, 2008

(54) DEVELOPING DEVICE AND IMAGE FORMING APPARATUS

(75) Inventors: Hiroyuki Hamakawa, Osaka (JP); Takaaki Kamei, Osaka (JP); Yoshihiro Yamagishi, Osaka (JP); Koji Suenami, Osaka (JP); Hirohisa Endou, Osaka (JP)

(73) Assignee: Kyocera Mita Corporation (JP)

( * ) Notice: Subject to any disclaimer, the term of this patent is extended or adjusted under 35 U.S.C. 154(b) by 183 days.

(21) Appl. No.: 11/434,852

(22) Filed: May 16, 2006

(65) Prior Publication Data

US 2006/0263111 A1 Nov. 23, 2006

(30) Foreign Application Priority Data

May 18, 2005 (JP) ..... 2005-145092

(51) Int. Cl.
*G03G 15/08* (2006.01)

(52) U.S. Cl. ..... 399/104

(58) Field of Classification Search ..... 399/104, 399/267–278

See application file for complete search history.

(56) References Cited

U.S. PATENT DOCUMENTS 6,101,354 A * 8/2000 Nakagawa et al. ..... 399/225

6,160,976 A * 12/2000 Karakama et al. ..... 399/104

FOREIGN PATENT DOCUMENTS

JP 2-262171 10/1990

* cited by examiner

*Primary Examiner*—Ryan Gleitz
(74) *Attorney, Agent, or Firm*—Gerald E Hespos; Anthony J. Casella

(57) ABSTRACT

A developing device includes a developing sleeve for supplying toner particles to a latent image area on a peripheral surface of a photoconductive drum while rotating about an axis. The developing sleeve has a permanent magnet therein. Two magnetic members are provided in the developing device and face opposite ends of a peripheral surface of the developing sleeve at a predetermined distance from the developing sleeve. The magnetic members have arc-shaped inner surfaces. A blade is spaced a predetermined distance from a central portion of the peripheral surface of the developing sleeve. The blade adjusts the amount of toner particles supplied to the photoconductive drum. The gap between the arc-shaped inner surface of the magnetic member and the peripheral surface of the developing sleeve gradually increases from upstream to downstream in a rotational direction of the developing sleeve.

20 Claims, 6 Drawing Sheets

DEVELOPING DEVICE AND IMAGE FORMING APPARATUS

BACKGROUND OF THE INVENTION

1. Field of the Invention

The present invention relates to a developing device in which toner particles are supplied to a static latent image formed on a peripheral surface of a photoconductive drum in an electrophotographic manner, and an image forming apparatus provided with the developing device.

2. Description of the Related Art

A predetermined developing device is used in an image forming apparatus which is operable to perform an electrophotographic manner. In the developing device, toner particles as a developer are supplied to a static latent image which is formed on a peripheral surface of a photoconductive drum in accordance with an image data. A toner image formed on the peripheral surface of the photoconductive drum by supplied toner as mentioned above is transferred onto a sheet which is an image bearing material conveyed from a sheet storage section with rotation of the photoconductive drum about an axis. A fixing device is provided on an immediately downstream of the photoconductive drum to perform a fixing process onto the sheet. A fixing process is conducted on the sheet onto which the toner image is transferred to fix the toner image on the sheet by heat. Then, the sheet is discharged to an outside after the completion of the fixing process.

The developing device includes stirring means for stirring a developer which includes only toner particles in the case of the one-component system, or a mixture of toner particles and carrier particles in the case of the two-component system, a cylindrical developing sleeve for supplying developer particles being stirred by the stirring means to the peripheral surface of the photoconductive drum, and a housing accommodating these members. In the case of the one-component system, toner particles supplied from a predetermined toner cartridge into the housing are stirred without adding an agent. In the case of the two-component system, toner particles are mixed and stirred with carrier particles put by a predetermined amount. Then, toner particles are supplied onto the peripheral surface of the photoconductive drum uniformly by a peripheral surface of the developing sleeve rotating about an axis. A blade is provided closely above the peripheral surface of the developing sleeve arranged along the peripheral surface of the photoconductive drum at a predetermined space. The blade removes surplus toner particles from the peripheral surface of the developing sleeve to thereby prevent excessive supply of toner particles to the photoconductive drum.

Meanwhile, there is the problem that when toner particles conveyed with the rotation of the developing sleeve reach the blade and some of the toner particles stray from a middle portion of the blade to the both ends of the blade, and disadvantageously leak from the respective ends of the developing sleeve.

In order to solve this disadvantage, Japanese Unexamined Patent Publication No. HEI 2-262171 discloses that a magnetic member is provided so as to face each of opposite end portions of a peripheral surface of the developing sleeve at a spacing from the peripheral surface of the developing sleeve so that the magnetic members and a magnet included in the developing sleeve form a magnetic brush having magnetic lines of force gathered on the peripheral surface of the developing sleeve. Accordingly, by taking such measure, the magnetic brush functions as a sealing member for a gap between the magnetic member and the developing sleeve. Consequently, leakage of toner particles is prevented.

Meanwhile, in the case where the structure for preventing leaking of toner particles disclosed in the Japanese Unexamined Patent Publication No. HEI 2-262171 is adapted, since a gap between an arc-shaped inner surface of the magnetic member and the peripheral surface of the developing sleeve is constant in a peripheral direction, a toner-restricting force of the magnetic brush is constant from upstream end to downstream end of the magnetic member. Thus, there exists an advantage that the toner particles are uniformly prevented from leaking in the area covered by the magnetic members. On the other hand, if the toner particles which are to be conveyed by the developing sleeve while restricted by the magnetic brush are deviated from the downstream end of the magnetic member, toner particles are released from the quite strong restricting force of the magnetic brush. Consequently, toner particles are scattered around by a reaction to cause a disadvantageous leakage of toner particles.

In the case where the gap between the downstream end of the magnetic member and the peripheral surface of the developing sleeve is narrowed by an accidental error in mounting the magnetic member, the toner particles moved to the downstream while restricted by a magnetic force is compressed in the narrowed gap. Accordingly, at the downstream end of the magnetic member, the toner particles which lose a space to move are forced to move to an inner portion of a seal (magnetic brush portion) having a space. Consequently, the magnetic restricting force with respect to toner particles is substantially lowered, and toner particles are caused to scatter around.

SUMMARY OF THE INVENTION

In view of the above problems, it is an object of the present invention to provide a developing device which can effectively prevent toner particles from scattering from downstream end of a developing sleeve, and an image forming apparatus provided with such developing device.

In order to achieve the object, a developing device according to an aspect of the present invention includes: a predetermined housing structure; a developing sleeve provided in a housing for supplying toner particles to a latent image area on a peripheral surface of a photoconductive drum while rotating about an axis, the developing sleeve including a magnet therein; a pair of magnetic members provided so as to face opposite end portions of a peripheral surface of the developing sleeve at a spacing of a predetermined distance from the peripheral surface of the developing sleeve, the magnetic members each having an inner surface having the shape of an arc; and a blade provided so as to face a central portion of the peripheral surface of the developing sleeve at a spacing of a predetermined distance from the peripheral surface of the developing sleeve, the blade being adapted for adjusting the amount of toner particles to be supplied to the photoconductive drum, wherein the gap between the arc-shaped inner surface of the magnetic member and the peripheral surface of the developing sleeve gradually increases from upstream to downstream in a rotational direction of the developing sleeve.

Further, according to another aspect of the present invention an image forming apparatus is constructed so as to supply toner particles to a static latent image formed on a peripheral surface of a photoconductive drum and thereby form a toner image, and transfer the toner image onto a sheet. The image forming apparatus is provided with the above-mentioned developing device to form the toner image.

With this construction, when the developing sleeve is rotated about an axis in the state where toner particles are filled in the housing, toner particles in the housing are led by the peripheral surface of the developing sleeve and moved toward the photoconductive drum. When the toner particles move through the gap between the lower end of the blade and the peripheral surface of the developing sleeve, amount of the toner particles is adjusted. Consequently, toner particles are supplied to the latent image area on the peripheral surface of the photoconductive drum rotating about an axis to thereby form a toner image. The toner image is transferred onto a sheet synchronously fed in response to the rotation of the photoconductive drum.

At each of the opposite ends of the developing sleeve, a magnetic member having a shape of an arc is provided so as to face the peripheral surface of the developing sleeve at a spacing of a predetermined distance. Therefore, even if the toner particles move toward the opposite ends of the developing sleeve, magnetic lines of force (magnetic brush) bridged between the magnetic members and the magnet provided in inner portion of the developing sleeve restrict the toner particles. Accordingly, the toner particles are prevented from further moving beyond the ends of the developing sleeve, and the toner particles are effectively prevented from leaking from ends of the developing sleeve.

In addition, since the gap formed between the arc-shaped inner surface of the magnetic member and the peripheral surface of the developing sleeve gradually increases from upstream to downstream in a rotational direction of the developing sleeve, a force which makes the compressed toner particles move outward is less likely to occur. Accordingly, the toner particles move smoothly to a toner holding area of the developing sleeve. Thus, leakage of the toner particles from ends of the developing sleeve can be restricted effectively.

DETAILED DESCRIPTION OF THE PREFERRED EMBODIMENTS

Figure 1:
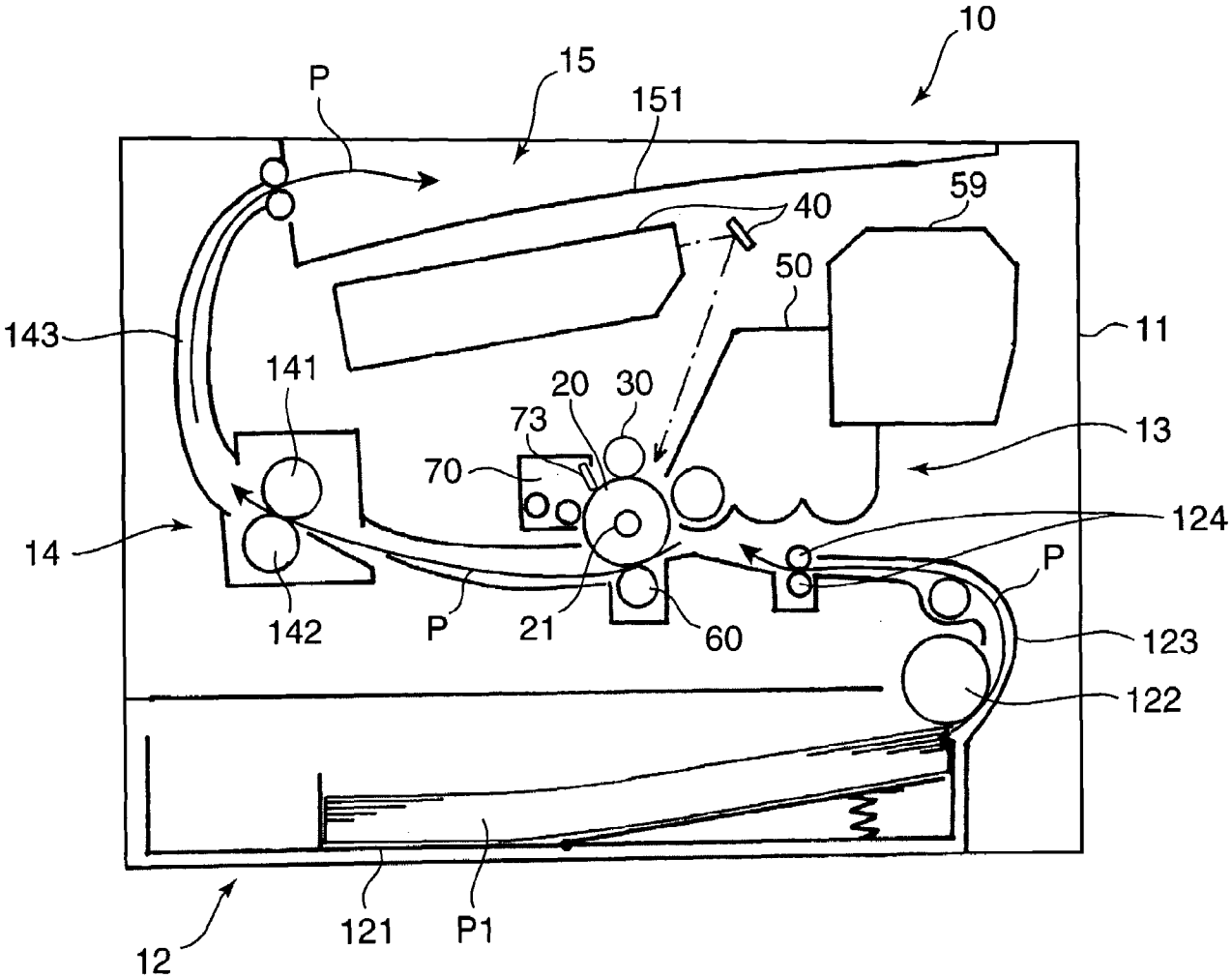
FIG. 1 is an explanatory sectional view showing a printer provided with a developing device according to an embodiment of the invention.

FIG. 1 is an explanatory sectional view showing an embodiment of a printer employing a developing device according to an embodiment of the present invention. As shown in FIG. 1, the printer 10 (an image forming apparatus) includes a sheet storage section 12 for storing sheets P to be subjected to a printing process, an image forming section 13 for performing an image transferring process to a sheet P picked up one by one from the sheet storage section 12, a fixing section 14 for performing a fixing process to the sheet P after being subjected to the transferring process in the image forming section 13, and a housing 11 for accommodating these sections. The printer 10 further includes a discharge section 15 provided at a top of the housing 11 where the sheet P subjected to the fixing process in the fixing section 14 is discharged.

In the sheet storage section 12, a predetermined number of sheet cassettes 121 (one in the present embodiment) is detachably mounted in the housing 11. On an upstream of the sheet cassette 121 (right side in FIG. 1), a picking-up roller 122 is provided for picking a sheet P one by one from the sheet stack P1. The sheet P picked up by the picking-up roller 122 from the sheet cassette 121 is conveyed to the image forming section 13 through a sheet conveyance passage 123 and a pair of registration rollers 124 provided on a downstream end of the sheet conveyance passage 123.

In the image forming section 13, the transferring process is performed on the sheet P based on image information electrically transmitted from a computer and the like. The image forming section 13 is provided with a charging roller 30, an exposure device 40, a developing device 50, a transferring roller 60, and a cleaning device 70, which are disposed along a peripheral surface of a photoconductive drum 20 provided rotatably about a drum shaft 21 extending in a forward and backward direction (a direction orthogonal to a sheet surface of FIG. 1), in a clockwise direction from a position immediately above the photoconductive drum 20.

The photoconductive drum 20 is adapted for forming a static latent image on a peripheral surface thereof, and then forming a toner image along the static latent image. The photoconductive drum 20 is formed with an amorphous silicon layer laminated on the peripheral surface thereof. The photoconductive drum 20 is integrally supported by a drum shaft 21 extending in the forward and backward direction and has a common center as the drum shaft 21. The photoconductive drum 20 is rotated together with the drum shaft 21 due to a rotation of the drum shaft 21 in the clockwise direction driven by an un-illustrated driving means.

The charging roller 30 charges uniformly over the peripheral surface of the photoconductive drum 20 rotating in the clockwise direction about a drum axis in such a manner that a peripheral surface of the charging roller 30 comes into contact with the peripheral surface of the photoconductive drum 20 so as to charge the peripheral surface of the photoconductive drum 20 while being rotationally driven by the photoconductive drum 20. A corona discharge may be adopted instead of the charging roller 30. In the corona discharge system, the peripheral surface of the photoconductive drum 20 can be charged by a corona discharge from a wire.

In the exposure device 40, a laser beam having an intensity varied based on an image data electrically transmitted from an external apparatus such as computer is irradiated on the peripheral surface of the photoconductive drum 20, and the electric charge is removed from the portion to which the laser beam is irradiated, and the static latent image is consequently formed on the surface.

In the developing device 50, toner particles T used as a developer is supplied on the peripheral surface of the photoconductive drum 20 so as to be adhered to the portion where the static latent image is formed. Thus, a toner image is formed on the peripheral surface of the photoconductive drum 20. In the present embodiment, a developer of one-component system consisting of toner particles T is employed. However, the developer of the present invention is not limited to the developer of one-component system. A developer of two-component system consisting of toner particles T and carrier may be used.

The toner particle T is a particle having a diameter of 6 to 12 μm, and including an additive agent such as color agent, charge control agent, and wax, these agent being dispersed in a binder resin. Meanwhile, the carrier is a magnetic particle such as magnetic iron ore ($Fe_3O_4$) having a diameter of 60 to 200 μm, and used for charging toner particles T. The toner particles T is a wasteful item necessary to be appropriately replenished from a toner cartridge 59 to the developing device 50. The carrier is put by a predetermined amount in the developing device 50, and generally used continuously without being consumed (In the present embodiment, no carrier is put in the developing device 50).

The transferring roller 60 is operable to transfer the positively charged toner image formed on the peripheral surface of the photoconductive drum 20 onto the sheet P fed to a position immediately beneath the photoconductive drum 20. The transferring roller 60 gives the sheet P negative charge which has the opposite polarity to the electric charge of the toner image.

The sheet P passing immediately beneath the photoconductive drum 20 is pressedly moved between the transferring roller 60 and the photoconductive drum 20, and the positively charged toner image on the peripheral surface of the photoconductive drum 20 is peeled off toward the negatively charged surface of the sheet P. In this manner, the transferring process is performed on the sheet P.

In the cleaning device 70, the photoconductive drum 20 after the completion of the transferring process is cleaned by removing toner particles T remaining on the peripheral surface of the photoconductive drum 20. The peripheral surface of the photoconductive drum, which is cleaned by the cleaning device 70, is advanced to the charging roller 30 again for operating the next image forming process.

In the fixing section 14, the fixing process is performed by heating the toner image on the sheet P to which the transferring process is performed in the image forming section 13. The fixing section 14 interiorly includes a heating roller 141 having an energized heating element, such as a halogen lamp and a pressing roller 142 disposed below the heating roller 141 in such a manner that the peripheral surface of the pressing roller 142 and the peripheral surface of the heating roller 141 face with each other. The sheet P after the completion of the transferring process is passed through a nip area between the heating roller 141 rotating in the clockwise direction about a roller shaft and the pressing roller 142 rotated along with the rotation of the heating roller 141 in a counterclockwise direction so as to be subjected to the fixing process by being heated by the heating roller 141. The sheet P after the completion of the fixing process is discharged to the discharge section 15 through a conveyance passage 143.

The discharge section 15 is defined by a concaved top of the housing 11, and provided with a discharge tray 151 for receiving the sheet P discharged on a bottom of the concaved portion.

Figure 2:
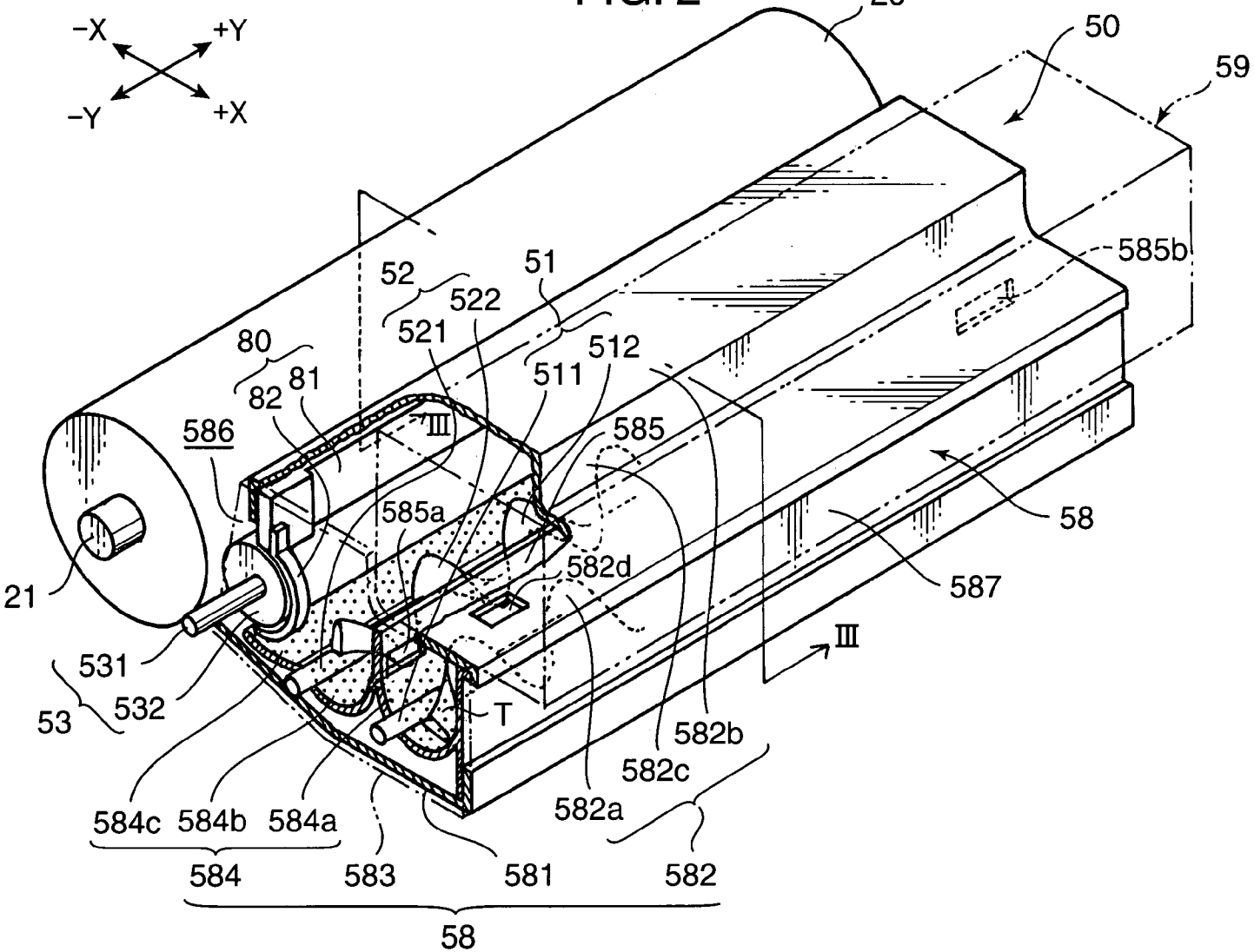
FIG. 2 is a partially cut-away perspective view showing a construction of the developing device according to an embodiment of the invention.
Figure 3:
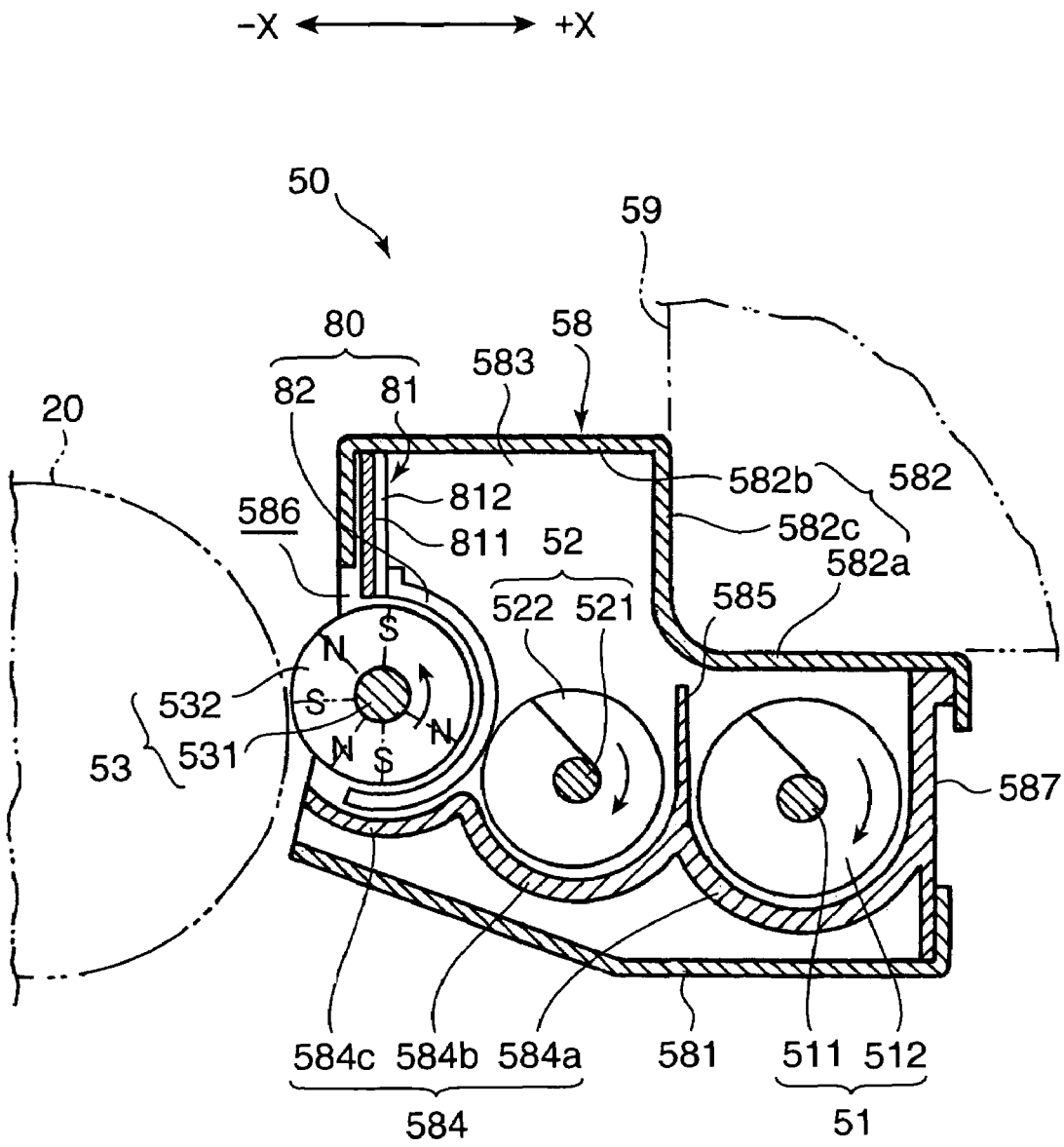
FIG. 3 is a cross sectional view taken along the line III-III in FIG. 2.

FIG. 2 is a partially cut-away perspective view showing a construction of the developing device 50. FIG. 3 is a cross sectional view taken along the line III-III in FIG. 2. In FIGS. 2 and 3, X-X indicates a leftward and rightward direction, and Y-Y indicates a forward and backward direction. Specifically, −X, +X, −Y, and +Y directions indicate the leftward, rightward, frontward and backward directions, respectively. As shown in FIGS. 2 and 3, the developing device 50 includes a first spiral feeder 51 for feeding toner particles replenished from the toner cartridge 59 backward while stirring toner particles, a second spiral feeder 52 for feeding toner particles received from the first spiral feeder 51 forward, and a developing sleeve 53 for receiving toner particles T being fed by the second spiral feeder 52 and feeding toner particles T to the latent image area on the peripheral surface of the photoconductive drum 20, in such a manner that the first spiral feeder 51, the second spiral feeder 52, and the developing sleeve 53 are mounted in a heteromorphic box-shaped housing 58.

As shown in FIGS. 2 and 3, the housing 58 is L-shaped in a front view from the −Y direction (FIG. 2). The housing 58 includes a bottom plate 581 extending from a substantially center portion in the leftward and rightward directions to the photoconductive drum 20 in such a manner that the left portion of the bottom plate 581 extends upwardly and a left end portion thereof faces the photoconductive drum 20, a top plate 582 disposed in an upside in an opposite relation to the bottom plate 581, a pair of side plates 583 formed between end portions in the forward and backward direction of the bottom plate 581 and the top plate 582 (a side plate in the forward direction is shown by a two-dot chain line in FIG. 2.), and a toner receiving tray 584 formed between the pair of side plates 583.

The top plate 582 is formed in a stepwise-shape having a left portion higher by one step, and includes a lower top plate **582*a* in the right side, a higher top plate 582*b* in the left side, and a vertical top plate 582*c* formed between a left end of the lower top plate 582*a* and a right end of the higher top plate 582*b*. A toner receptive opening 582*d* for receiving toner particles from the toner cartridge 59 is provided in a front end portion of the lower top plate 582*a*. A toner supply opening 586 for supplying toner particles T in the housing 58 to the peripheral surface of the photoconductive drum 20 is provided in an opposite relation to the peripheral surface of the photoconductive drum 20 between a left end of the higher top plate 582*b* and a left end of the bottom plate 581**.

The toner receiving tray 584 is provided with a first tray **584*a* for accommodating the first spiral feeder 51, a second tray 584*b* for accommodating the second spiral feeder 52, a third tray 584*c* disposed in opposite relation to the developing sleeve 53 in the lower portion. Each of the first to third trays 584*a*, 584*b*, and 584*c* is formed in an arc shape from a front view for accommodating the first and second spiral feeder 51 and 52, and the developing sleeve 53, respectively. Further, a right side wall 587 is formed in a right end portion of the first tray 584*a*, and the right side wall 587 is also formed between the respective right ends of the bottom plate 581 and the lower top plate 582*a*, thereby closing a right side of the housing 58**.

The first spiral feeder 51 includes a first feeder shaft 511 penetrating between the pair of the side walls 583 immediately above the first tray **584*a*, and a first spiral fin 512 fixedly attached to the first feeder shaft 511 and having a common center as the first feeder shaft 511. The first spiral fin 512 is formed in a left hand thread spiral manner. The first feeder shaft 511 is rotated in the clockwise direction in a front view, accordingly, toner particles T on the first tray 584*a*** are fed backward.

The second spiral feeder 52 includes a second feeder shaft 521 penetrating between the pair of side plates 583 immediately above the second tray **584*b*, and a second spiral fin 522 fixedly attached to the second feeder shaft 521 and having a common center as the second spiral fin 522. The second spiral fin 522 is formed in a right hand thread spiral manner. The second feeder shaft 521 is rotated in the clockwise direction in a front view, accordingly toner particles T on the second tray 584*b*** are fed forward.

A dividing wall 585 is formed between the first and second trays **584*a* and 584*b*. A forward distribution opening 585*a* is provided in the forward portion of the dividing wall 585, and a backward distribution opening 585*b* is provided in the backward portion thereof. Toner particles T fed in the casing 58 from the toner cartridge 59 through the toner receptive opening 582*d* are fed backward by the rotation of the first spiral feeder 51 in the first tray 584*a*, and fed in the second tray 584*b*** through the backward distribution opening 585*b*, and then, fed forward by the rotation of the second spiral feeder 52 in the second tray 584*b*. Hereafter, a part of toner particles are supplied to the developing sleeve 53 while circulating between the first and second tray 584*a* and 584*b*.

The developing sleeve 53 includes a sleeve shaft 531 penetrating between the side walls 583 and a sleeve main body 532. The sleeve main body 532 has a common axis as the sleeve shaft 531 and is placed around the sleeve shaft 531 so as to rotate about the sleeve shaft 531. The developing sleeve 53 is provided so that a peripheral surface of the sleeve main body 532 faces the peripheral surface of the photoconductive drum 20 through the toner supply opening 586. The developing sleeve 53 is rotated in a counter-clockwise direction in FIG. 3 about the sleeve shaft 531 by driving of an unillustrated driving means and thereby moves toner particles T which are sent onto a third tray 584*c* to the peripheral surface of the photoconductive drum 20.

Figure 4:
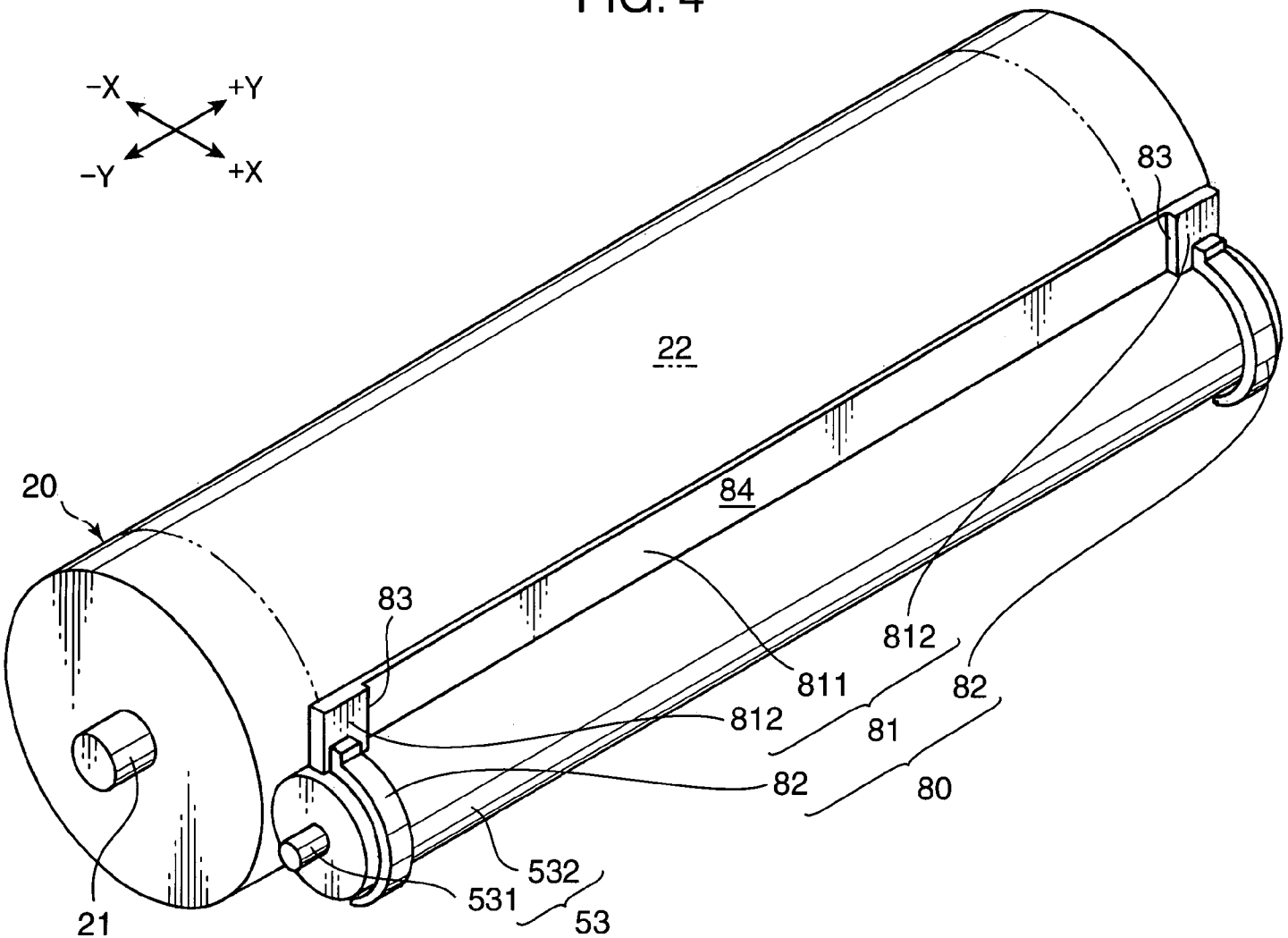
FIG. 4 is an explanatory perspective view showing a toner leakage preventing structure.
Figure 5:
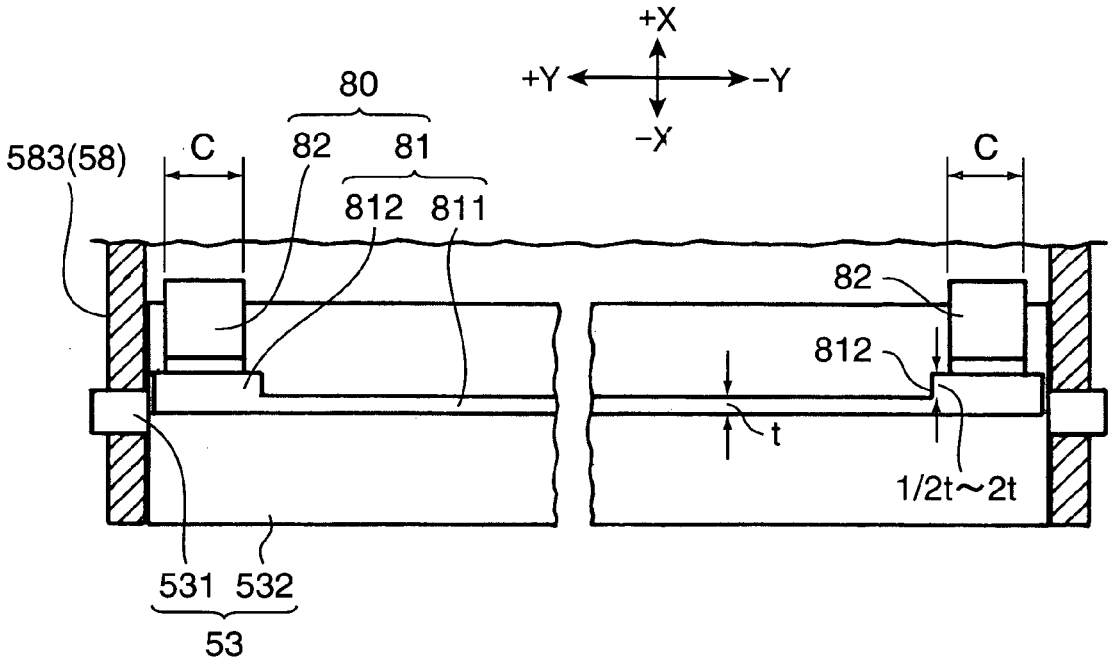
FIG. 5 is an explanatory plan view showing the toner leakage preventing structure in FIG. 4.
Figure 6:
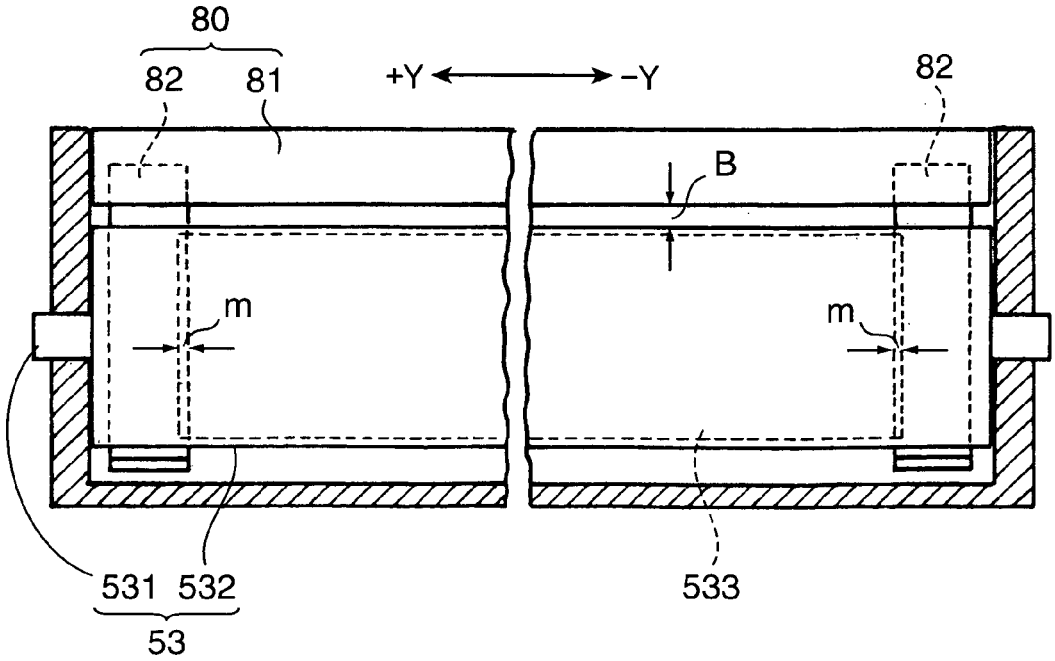
FIG. 6 is an explanatory side view showing the toner leakage preventing structure shown in FIG. 4.
Figure 7:
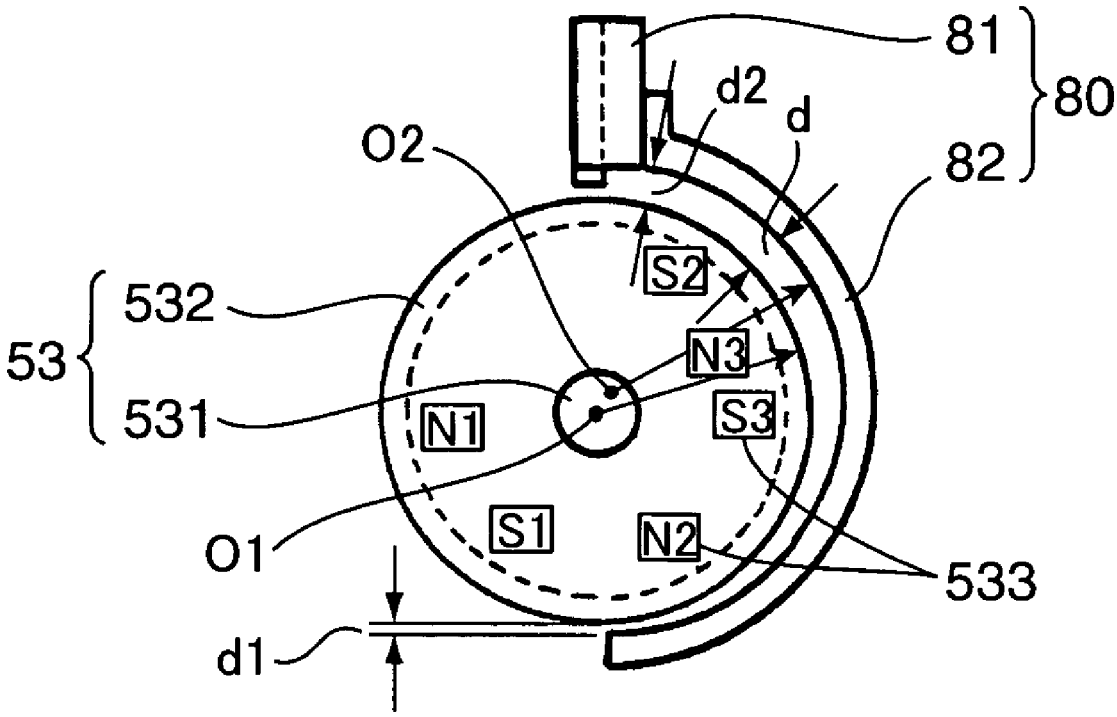
FIG. 7 is an explanatory front view showing the toner leakage preventing structure shown in FIG. 4.

In the present embodiment, the developing device 50 constructed as above is provided with a toner leakage preventing structure 80 in which toner particles T are appropriately supplied to the photoconductive drum 20 and prevented to leak from an end portion of the sleeve main body 532. FIG. 4 is an explanatory perspective view showing the toner leakage preventing structure 80. FIG. 5 is an explanatory plan view showing the toner leakage preventing structure 80 shown in FIG. 4. FIG. 6 is an explanatory side view of the toner leakage preventing structure 80. FIG. 7 is an explanatory plan view of the toner leakage preventing structure 80. Directions indicated by references X and Y in FIGS. 4 to 7 are the same as those in FIG. 2 (The reference X indicates the leftward and rightward direction in such a manner that the −X indicates the leftward, and the +X indicates the rightward. The reference Y indicates the forward and backward direction in such a manner that the −Y indicates the forward, and the +Y indicates the backward.). Hereinafter, the toner leakage preventing structure 80 is described referring to FIGS. 4 to 7, and FIGS. 1 to 3 as appropriately.

As shown in FIG. 4, the toner leakage preventing structure 80 includes a blade 81 drooping from a left end portion of the higher top plate 582*b* of the casing 58 shown in FIG. 2 to a peripheral surface of the sleeve main body 532 and extending in the forward and backward directions, a pair of magnetic members 82 disposed in the opposite ends of the sleeve main body 532 in a right side of the sleeve main body 532.

The blade 81 is employed for controlling the amount of toner particles T supplied to a latent image area 22 (an area defined between the two-dot chain line shown in FIG. 4, where the static latent image is formed) on the peripheral surface of the photoconductive drum 20 by a rotation of the developing sleeve about the sleeve shaft tube 531 so as to prevent toner particles T from being supplied excessively. A gap B having a gap size of 0.1 mm to 0.5 mm is provided between a bottom end of the blade 81 and the peripheral surface of the developing sleeve 53 (see FIG. 6). In the case where the gap B is less than 0.1 mm, the gap is too narrow to appropriately supply toner particles T to the peripheral surface of the photoconductive drum 20, therefore, a toner image having an appropriate density is hard to be formed. On the other hand, in the case where the gap is above 0.5 mm, toner particles T are excessively supplied to the photoconductive drum 20. Therefore, an excessively dark toner image is apt to be formed on the latent image area 22 of the photoconductive drum 20.

The blade 81 includes a thin portion 811 facing the latent image area 22 in the center of the longitudinal direction, and a pair of thick portions 812 on the opposite end portions. The thick portion 812 projects rightward from the thin portion 811 at the both end portions of the blade 81 (in other words, the thick portion 812 projects inward of the casing 58 shown in FIG. 2.). Step portions 83 are formed at the respective boundaries between the thin portion 811 and the thick portion 812. A concave portion 84 is formed by the pair of step portions 83 and right surface of the thin portion 811.

The step portion 83 is formed to prevent toner particles T from leaking from the end portion of the sleeve main body 532 when toner particles T guided to the peripheral surface of the developing sleeve 53 due to the rotation thereof and forwarded to the photoconductive drum 20 hit the blade 81, and toner particles T partially move outward in the longitudinal direction. In other words, though toner particles T hitting the thin portion 811 of the blade 81 moves in the forward and backward direction, since the step portions 83 are formed on the opposite end portions of the thin portion 811, the movement of toner particles T in the forward and backward direction are controlled by the step portions 83 to move upwardly. Therefore, toner particles T are prevented from leaking from the end portion of the sleeve main body 532.

The vertical dimension of the blade 81 is set at substantially 25 mm depending on the local conditions in the present embodiment. According to the invention, however, the vertical dimension of the blade 81 is not limited to 25 mm, and the dimension can be appropriately set according to a situation, such as a design condition and the like. Further, a thickness of the thick portion 812 (FIG. 5) is thicker than the thin portion 811 within a range of half to twice of the thickness t of the thin portion 811 (In the present embodiment, the thickness t of the thin portion 811 is 2.0 mm).

The reason why such range is set is as follows. In the case where the step portion 83 is smaller than half of the thickness t of the thin portion 811 ($t\times 1/2$), the step is too small to control the movement of toner particles T in the lateral direction. On the other hand, in the case where the step portion 83 is above twice of the thickness t of the thin portion 811 ($t\times 2$), it is difficult to dispose the thick portion 812 at an appropriate portion due to the size.

The thickness of the thick portion 812 (FIG. 5) is not limited to the thickness thicker than the thin portion 811 by half to twice of the thickness t of the thin portion 811. An optimal value may be appropriately set according to the situations, such as a design or size condition.

In the present embodiment, the blade 81 is made of a magnetic material to cause magnetic fluxes of a permanent magnet 533 (FIG. 6) interiorly placed in the sleeve main body 532 to easily pass the blade 81, and bring about a short magnetic field in the gap between the end edge of the blade 81 and the peripheral surface of the sleeve main body 532. In this manner, toner particles T are properly supplied to the photoconductive drum 20 by the short magnetic field.

The magnetic member 82 is adapted to prevent toner particles T from moving toward the ends of the peripheral surface of the sleeve main body 532 with which toner particles T come into contact until toner particles T reach the blade 81 in the housing 58. The magnetic member 82 is formed into an arc shape whose center angle is substantially 180°. As shown in FIG. 3, an upper end of the magnetic member 82 is fixedly attached to the thick portion 812 of the blade 81, and a lower end of the magnetic member 82 is disposed in opposite relation to the third tray 584*c* of the casing 58. With this construction, it is ensured to mount the magnetic member 82 to be spaced from the sleeve main body 532.

According to the magnetic member 82 constructed as above, a magnetic brush by the magnetic fluxes is formed between the magnetic member 82 and the permanent magnet 533 interiorly disposed in the sleeve main body 532 so as to control the movement of toner particles T, thereby effectively preventing the movement of toner particles T on the peripheral surface of the sleeve main body 532 toward the end thereof.

As shown in FIG. 6, a position of the magnetic member 82 is set so that an end of inner side of the magnetic member 82 overlaps an end of the sleeve magnet 533 in an axial direction of the sleeve main body 532 (leftward and rightward directions on the surface of FIG. 6). Amount of overlap m is set 0.5 mm in the embodiment. However, the amount of overlap m is not restricted to 0.5 mm but can be set correspondingly to condition. By setting the amount of overlap m, a magnetic brush formed by the sleeve magnet 533 is made straight toward a radial direction of the sleeve magnet 533. Consequently, an effect of a magnetic force of the magnetic brush is maximized so that a movement of toner particles T toward ends of the sleeve main body 532 is restricted.

Further, a frontward and backward width size C of the magnetic member 82 is set in a range from 2 mm to 10 mm. The reason why such range is set as the frontward and backward width size C is as follows. In the case where the frontward and backward width size of the magnetic member 82 is smaller than 2 mm, the width size becomes too short. Consequently, a toner movement restricting force of the magnetic brush becomes too weak to sufficiently restrict toner particles T on the peripheral surface of the sleeve main body 532 from moving toward ends of the sleeve main body 532. On the other hand, in the case where the width size of the magnetic member 82 is larger than 10 mm, the toner particle movement restricting force is not enhanced any further, and there is no necessity to make the width size larger than 10 mm.

As shown in FIG. 7, a gap d between the inner surface the magnetic member 82 and the peripheral surface of the sleeve main body 532 gradually increases from upstream to downstream in a rotational direction of the developing sleeve 53. In the embodiment, the gap d (minimum gap distance d1) at upstream end (immediately beneath position the sleeve main body 532) of the magnetic member 82 is set 0.2 mm. On the other hand, the gap size d (maximum gap distance d2) at downstream end (immediately above the sleeve main body 532) is set 0.5 mm. The gap d gradually increases from 0.2 mm to 0.5 mm in a direction from upstream end to downstream end.

Such construction is adapted to suppress generation of a force which makes compressed toner particles T move outward. Accordingly, toner particles T are moved smoothly to a toner holding area of the developing sleeve 53 and thereby scattering of the toner particles T from ends of the developing sleeve 53 is prevented.

In the embodiment, the inner surface of the magnetic member 82 is formed to have a curvature center O2 which is same as that of the peripheral surface of the developing sleeve 53. In other words, the inner surface of the magnetic member 82 is an arc-shaped surface having a predetermined radius centering on the point O2. A relative arrangement of the magnetic member 82 against the developing sleeve 53 is set so that a position of the curvature center of the magnetic member 82 is shifted from a center O1 which is a center of the axis of the developing sleeve 53 in a predetermined direction to thereby cause the gradual increase in the gap d. Particularly, by setting a position of the curvature center O2 so that the curvature center O2 is slightly shifted upward in FIG. 7 from the center O1 of the developing sleeve 53. Consequently, the gap d gradually increases from upstream to downstream of the magnetic member 82.

As described above, the developing device 50 according to the invention comprises: a predetermined housing structure 58; a developing sleeve 53 provided in the housing 58 for supplying toner particles T to a latent image area 22 on a peripheral surface of the photoconductive drum 20 while rotating about the axis 531, the developing sleeve including a magnet 533 therein; a pair of magnetic members 82 provided so as to face opposite end portions of a peripheral surface of the developing sleeve 53 at a spacing of a predetermined distance from the peripheral surface of the developing sleeve 53, the magnetic members 82 each having an inner surface having the shape of an arc; and the blade 81 provided so as to face a central portion of the peripheral surface of the developing sleeve 53 at a spacing of a predetermined distance from the peripheral surface of the developing sleeve a predetermined distance, the blade 81 being adapted for adjusting the amount of toner particles to be supplied to the photoconductive drum; wherein the gap between the arc-shaped inner surface of the magnetic member 82 and the peripheral surface of the developing sleeve 53 gradually increases from upstream to downstream in a rotational direction of the developing sleeve 53.

With this construction, by rotating the developing sleeve 53 about the axis 531 in the state where toner particles T are filled in the housing 58, the toner particles T in the housing 58 are led to the peripheral surface of the developing sleeve 53 and conveyed toward the photoconductive drum 20. Then, toner particles T pass through a gap between the lower end of the blade 81 and the peripheral surface of the developing sleeve 53 and are supplied to the latent image area 22 of the peripheral surface of the photoconductive drum 20 which is rotated about the axis to thereby form a toner image. The toner image is transferred onto a recording medium P which is synchronously conveyed in accordance with a rotation of the photoconductive drum 20.

Since the magnetic member 82 having an arc-shaped inner surface is mounted so as to face each of opposite ends of the peripheral surface of the developing sleeve 53, even if toner particles T moves toward opposite ends of the developing sleeve 53, magnetic lines of force (magnetic brush) bridged between the magnetic member 82 and the magnet 533 mounted in inner portion of the developing sleeve 53 restricts toner particles T to thereby prevent further movement of toner particles T. Consequently, leakage of toner particles T from ends of the developing sleeve 53 is effectively prevented.

In addition, the gap d formed between the arc-shaped inner surface of the magnetic member 82 and the peripheral surface of the developing sleeve 53 gradually increases from upstream to downstream in a rotational direction of the developing sleeve 53. Consequently, generation of a force which makes compressed toner particles T move outward is not likely to be generated. Accordingly, toner particles T move smoothly to the toner holding area of the developing sleeve 53, and, as a result, leakage of toner particles T from ends of the developing sleeve 53 can be prevented.

The printer 10 employing the above mentioned developing device 50 enjoys the effect of effectively preventing such disadvantages as internal contamination by leaked toner particles T.

The present invention is not limited to the foregoing embodiments, but the following modification may be made.

In the above-described embodiment, the gap d between the peripheral surface of the sleeve main body 532 and an inner surface of the magnetic member 82 has a minimum distance d1 of 0.2 mm and a maximum distance d2 of 0.5 mm. However, the invention is not limited to have the minimum distance d1 of 0.2 mm and the maximum distance d2 of 0.5 mm.

In accordance with a strength of a magnetic force of the magnet 533, a radial size and a rotational speed of the developing sleeve 53, kinds of toner particles T and such, appropriate values are set desirably. However, it is preferable that the gap d is set within a range between 0.1 mm and 1.0 mm. This is because it is likely that the gap becomes so narrow that the peripheral surface of the sleeve main body and the inner surface of the magnetic member 82 come to contact with each other. Further, it is likely that it becomes hard to make a substantial difference between the minimum gap d1 and the maximum gap d2. On the other hand, if the gap d becomes larger than 1.0 mm, assured leakage preventing effect of the magnetic brush with respect to toner particles T can not be obtained.

In the above-described embodiment, the inner surface of the magnetic member 82 has a shape of an arc having the same curvature center O2 along the entire length, and a position of the curvature center O2 is set so as to be slightly shifted upward from the center O1 of the developing sleeve 53 and toward inner part of the housing 58. Accordingly, the gap d increases from upstream to downstream of the magnetic member 82. Instead of this, the gap d can be defined by a shape of the inner surface of the magnetic member 82, for example, by making the curvature center O2 of the inner surface of the magnetic member 82 conform with the center O1 of the sleeve main body 532 and gradually increasing the curvature radius of the inner surface. Accordingly, a shape of the inner part of the magnetic member 82 is not limited to an accurate arc but can be set in correspondence with the situation. Consequently, a shape of the gap can be set in accordance with a real situation, and variance of a gap forming can be enhanced.

In the embodiment, a printer 10 is described as an example of an image forming apparatus employing the developing device 50. However, an image forming apparatus of the invention is not limited to the printer 10 but can be a copying machine, a facsimile apparatus or a scanner which reads out and electrically transfers image information.

In the embodiment, the blade 81 is formed uniformly by applying cutting work or by hammering. However, instead, the blade 81 can be fabricated by preparing a thin portion 811 in advance and attaching to opposite ends of the thin portion 811 short pieces for forming the thick portions 812.

In the embodiment, the blade 81 is formed by the thin portion 811 and the thick portions 812 and step 83 is formed between boundaries of the thin portion 811 and the thick portion 813. However, a slope can be formed in place of the step 83. Further, in place of the thin portion 811, this portion can be formed arc-shaped as a whole.

In the embodiment, toner particles T are supplied from the detachably mounted toner cartridge 59 to the developing device 50. However, the present invention is not limited to that the developing device 50 and the toner cartridge 59 are detachable. For example, it can be a developing unit which is formed by unifying the toner cartridge 59 with the housing 58 of the developing device 50. In the case of using the developing unit, a shortage of toner particles can be dissolved by replacing old developing unit with new one.

This application is based on patent application No. 2005-145092 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A developing device comprising:

a predetermined housing structure;

a developing sleeve provided in a housing for supplying toner particles to a latent image area on a peripheral surface of a photoconductive drum while rotating about an axis, the developing sleeve including a magnet therein;

a pair of magnetic members provided so as to face opposite end portions of a peripheral surface of the developing sleeve at a spacing of a predetermined distance from the peripheral surface of the developing sleeve, the magnetic members each having an inner surface having the shape of an arc; and a blade provided so as to face a central portion of the peripheral surface of the developing sleeve at a spacing of a predetermined distance from the peripheral surface of the developing sleeve, the blade being adapted for adjusting the amount of toner particles to be supplied to the photoconductive drum;

wherein the magnetic member and the developing sleeve are mounted to maintain a gap between the arc-shaped inner surface of the magnetic member and the peripheral surface of the developing sleeve that gradually increases from upstream to downstream in a rotational direction of the developing sleeve.

2. A developing device according to claim 1, wherein the gradually increased gap is defined by a relative arrangement of the magnetic member against the developing sleeve.

3. A developing device according to claim 2, wherein the arc-shaped inner surface of the magnetic member has the same curvature as the peripheral surface of the developing sleeve, and the curvature center of the arc-shaped inner surface of the magnetic member is shifted from an axis of the developing sleeve in a predetermined direction to thereby cause the gradual increase in the gap.

4. A developing device according to claim 1, wherein the gradually increased gap is defined by a shape of the inner surface of the magnetic member.

5. A developing device according to claim 4, wherein the gradually increased gap is defined by the inner surface of the magnetic member that has a shape of an arc whose curvature radius gradually increases from upstream to downstream in the rotational direction of the developing sleeve.

6. A developing device according to claim 1, wherein the inner surface of the magnetic member has a shape of an arc whose curvature center angle is substantially 180 degrees.

7. A developing device according to claim 1, wherein the magnetic member partly overlaps an end of a magnet provided in the developing sleeve in an axial direction of the developing sleeve.

8. A developing device according to claim 1, wherein the gradually increased gap has a minimum distance and a maximum distance within a range from 0.1 mm to 1.0 mm.

9. An image forming apparatus for forming a toner image on a peripheral surface of a photoconductive drum and transferring the toner image to a recording medium, comprising a developing device, the developing device including:

a predetermined housing structure;

a developing sleeve provided in a housing for supplying toner particles to a latent image area on a peripheral surface of a photoconductive drum while rotating about an axis, the developing sleeve including a magnet therein;

a pair of magnetic members provided so as to face opposite end portions of a peripheral surface of the developing sleeve at a spacing of a predetermined distance from the peripheral surface of the developing sleeve, the magnetic members each having an inner surface having the shape of an arc; and a blade provided so as to face a central portion of the peripheral surface of the developing sleeve at a spacing of a predetermined distance from the peripheral surface of the developing sleeve, the blade being adapted for adjusting the amount of toner particles to be supplied to the photoconductive drum;

wherein the magnetic member and the developing sleeve are mounted to maintain a gap between the arc-shaped inner surface of the magnetic member and the peripheral surface of the developing sleeve that gradually increases from upstream to downstream in a rotational direction of the developing sleeve.

10. An image forming apparatus according to claim 9, wherein the gradually increased gap is defined by a relative arrangement of the magnetic member against the developing sleeve.

11. An image forming apparatus according to claim 10, wherein the arc-shaped inner surface of the magnetic member has the same curvature as the peripheral surface of the developing sleeve, and the curvature center of the arc-shaped inner surface of the magnetic member is shifted from an axis of the developing sleeve in a predetermined direction to thereby cause the gradual increase in the gap.

12. An image forming apparatus according to claim 9, wherein the gradually increased gap is defined by a shape of the inner surface of the magnetic member.

13. An image forming apparatus according to claim 12, wherein the gradually increased gap is defined by the inner surface of the magnetic member that has a shape of an arc whose curvature radius gradually increases from upstream to downstream in the rotational direction of the developing sleeve.

14. An image forming apparatus according to claim 9, wherein the inner surface of the magnetic member has a shape of an arc whose curvature center angle is substantially 180 degrees.

15. An image forming apparatus according to claim 9, wherein the magnetic member partly overlaps an end of a magnet provided in the developing sleeve in an axial direction of the developing sleeve.

16. An image forming apparatus according to claim 9, wherein the gradually increased gap has a minimum distance and a maximum distance within a range from 0.1 mm to 1.0 mm.

17. A developing device comprising:

a predetermined housing structure;

a developing sleeve provided in a housing for supplying toner particles to a latent image area on a peripheral surface of a photoconductive drum while rotating about an axis, the developing sleeve including a magnet therein;

a blade provided so as to face a central portion of the peripheral surface of the developing sleeve at a spacing of a predetermined distance from the peripheral surface of the developing sleeve, the blade being adapted for adjusting the amount of toner particles to be supplied to the photoconductive drum; and a pair of magnetic members provided so as to face opposite end portions of a peripheral surface of the developing sleeve at a spacing of a predetermined distance from the peripheral surface of the developing sleeve, the magnetic members each having an inner surface having the shape of an arc whose curvature radius gradually increases from upstream to downstream in the rotational direction of the developing sleeve so that a gap between the arc-shaped inner surface of the magnetic member and the peripheral surface of the developing sleeve gradually increases from upstream to downstream in a rotational direction of the developing sleeve arc.

18. A developing device according to claim 17, wherein the inner surface of the magnetic member has a shape of an arc whose curvature center angle is substantially 180 degrees.

19. A developing device according to claim 17, wherein the magnetic member partly overlaps an end of a magnet provided in the developing sleeve in an axial direction of the developing sleeve.

20. A developing device according to claim 17, wherein the gradually increased gap has a minimum distance and a maximum distance within a range from 0.1 mm to 1.0 mm.

* * * * *